US009938062B1

(12) United States Patent
Scarlett

(10) Patent No.: US 9,938,062 B1
(45) Date of Patent: Apr. 10, 2018

(54) ELASTIC TIE AND METHODS OF USING AND MANUFACTURING THE SAME

(71) Applicant: Christopher Scarlett, Ellensburg, WA (US)

(72) Inventor: Christopher Scarlett, Ellensburg, WA (US)

( * ) Notice: Subject to any disclaimer, the term of this patent is extended or adjusted under 35 U.S.C. 154(b) by 0 days.

(21) Appl. No.: 14/842,723

(22) Filed: Sep. 1, 2015

Related U.S. Application Data

(60) Provisional application No. 62/044,365, filed on Sep. 1, 2014.

(51) Int. Cl.
*B65D 63/04* (2006.01)
*B65D 63/10* (2006.01)

(52) U.S. Cl.
CPC ..... *B65D 63/04* (2013.01); *B65D 63/109* (2013.01); *B65D 2563/107* (2013.01)

(58) Field of Classification Search
CPC ..... B65D 63/04; B65D 63/12; B65D 63/109; B65D 2563/107; B65D 63/00; B65D 63/02; B65D 63/10; B21F 17/00; Y10T 24/157
See application file for complete search history.

(56) References Cited

U.S. PATENT DOCUMENTS 1,158,957 A * 11/1915 Bates ..... B65D 63/12 24/27
2,542,601 A * 2/1951 Van Cleef ..... A45D 2/18 132/246
2,648,879 A 8/1953 Patterson
2,699,585 A 1/1955 Patterson
2,943,371 A 7/1960 Patterson
3,048,906 A 8/1962 Patterson
3,543,353 A * 12/1970 Meehan ..... B65D 63/10 24/16 PB
3,857,139 A * 12/1974 Turner ..... B65D 63/10 229/87.09

(Continued)

FOREIGN PATENT DOCUMENTS

WO 2011043677 9/2013

OTHER PUBLICATIONS

Cable Buddy®—Cable Organizer Ties with Color ID Labels. Earliest date: Jul. 18, 2011. Website screenshot , Oct. 2, 2015, <http://www.amazon.com/Cable-Buddy%C2%AE-5-pack-Black-Organizer/dp/B00288OOQI/ref=sr_1_2?s=arts-crafts&ie=UTF8&qid=1443822764&sr=8-2&keywords=Cable+Buddy+-+Cable+Organizer+Ties+with+Color+ID+Label>.

(Continued)

*Primary Examiner* — Robert Sandy
*Assistant Examiner* — Rowland Do
(74) *Attorney, Agent, or Firm* — DWC Law Firm, P.S.; David Chen

(57) ABSTRACT

Tying devices, and methods of using and manufacturing the same are provided. The tying devices can include an elastic band having at least one elongated malleable member attached to at least one end thereof. When the tying devices are wrapped about an object, under tension, in self-overlapping configuration, and the elongated malleable member is bent to approximate a surface contour of the object, even without wrapping the malleable member fully around the object, the combination of friction between the overlapping surfaces of the elastic band, and the rigidity of the elongated malleable member, can be sufficient to retain the tying device securely under tension.

17 Claims, 9 Drawing Sheets

(56) References Cited

U.S. PATENT DOCUMENTS

| | | | | | |
|---|---|---|---|---|---|
| 3,909,979 | A * | 10/1975 | Perez | A01G 5/00 | 24/30.5 T |
| 3,953,911 | A | 5/1976 | Fishack | | |
| 4,156,443 | A * | 5/1979 | Nishikawa | B65B 13/06 | 100/26 |
| 4,158,250 | A | 6/1979 | Ringwald | | |
| 4,569,108 | A | 2/1986 | Schwab | | |
| 4,689,858 | A | 9/1987 | Barber | | |
| 4,831,692 | A | 5/1989 | Chuan | | |
| 4,991,265 | A | 2/1991 | Campbell | | |
| 5,062,184 | A | 11/1991 | Rowland | | |
| 5,093,964 | A | 3/1992 | Rowland | | |
| 5,154,964 | A | 10/1992 | Iwai | | |
| 5,199,135 | A | 4/1993 | Gold | | |
| 5,317,788 | A | 6/1994 | Esposito | | |
| 5,498,190 | A * | 3/1996 | Ganson | A63H 33/04 | 446/107 |
| 5,499,638 | A * | 3/1996 | Ripley | A45D 8/36 | 132/246 |
| 5,502,877 | A | 4/1996 | Yocum | | |
| 5,515,580 | A | 5/1996 | McHenry, Jr. | | |
| 5,664,589 | A * | 9/1997 | Black | A45D 8/34 | 132/246 |
| 5,715,578 | A | 2/1998 | Knudson | | |
| 5,853,212 | A | 12/1998 | Daniel | | |
| 5,875,792 | A * | 3/1999 | Campbell, Jr. | A45D 2/18 | 132/246 |
| 5,893,456 | A | 4/1999 | Bosmans | | |
| 5,896,623 | A | 4/1999 | Martin | | |
| 5,916,006 | A * | 6/1999 | Ganson | A63H 33/00 | 446/107 |
| 6,113,170 | A | 9/2000 | Daniel | | |
| 6,276,031 | B1 | 8/2001 | Haiduk | | |
| 6,328,186 | B1 * | 12/2001 | Wing | A47G 25/20 | 223/89 |
| 6,386,207 | B2 * | 5/2002 | Stewart | A45D 8/34 | 132/275 |
| 6,389,655 | B2 | 5/2002 | Libecco | | |
| 6,393,670 | B1 | 5/2002 | Bealmear | | |
| 6,397,854 | B1 * | 6/2002 | Bailey | A44C 5/0053 | 132/200 |
| 6,490,767 | B2 | 12/2002 | Haiduk | | |
| 6,543,094 | B2 | 4/2003 | D'Addario | | |
| 6,606,765 | B2 | 8/2003 | Edmondson | | |
| 6,842,948 | B2 | 1/2005 | Smith | | |
| 6,868,589 | B2 | 5/2005 | Borne | | |
| 7,011,879 | B1 | 3/2006 | Contreras | | |
| 7,192,069 | B1 | 3/2007 | Daniel | | |
| 7,219,397 | B2 | 5/2007 | Bishop | | |
| 7,341,296 | B2 | 3/2008 | Daniel | | |
| 7,458,623 | B2 | 12/2008 | Daniel | | |
| 7,469,946 | B2 | 12/2008 | Daniel | | |
| 7,634,842 | B2 | 12/2009 | Santisi | | |
| 7,673,919 | B2 | 3/2010 | Daniel | | |
| 8,056,948 | B2 | 11/2011 | Daniel | | |
| 8,240,467 | B2 | 8/2012 | Bosmans | | |
| 8,256,812 | B2 | 9/2012 | Daniel | | |
| 8,387,216 | B1 | 3/2013 | Martinson | | |
| 8,399,769 | B2 | 3/2013 | Doll | | |
| D679,701 | S | 4/2013 | Adelman | | |
| 8,485,578 | B2 | 7/2013 | Daniel | | |
| 8,776,322 | B2 | 7/2014 | Martinson | | |
| 8,806,723 | B2 | 8/2014 | Martinson | | |
| 8,910,347 | B1 | 12/2014 | Wilcox | | |
| D749,409 | S * | 2/2016 | Martinson | D8/396 | |
| 9,308,465 | B2 * | 4/2016 | Cheung | A63H 33/08 | |
| 2005/0039310 | A1 | 2/2005 | Borne | | |
| 2008/0313957 | A1 * | 12/2008 | Long | A01G 9/128 | 47/44 |
| 2013/0026316 | A1 | 1/2013 | Case | | |
| 2013/0232731 | A1 | 9/2013 | Schradin | | |
| 2014/0000532 | A1 * | 1/2014 | Cogswell | A01K 15/025 | 119/708 |
| 2014/0290011 | A1 | 10/2014 | Gallup | | |
| 2016/0355309 | A1 * | 12/2016 | Clark | B65D 63/12 | |

OTHER PUBLICATIONS

Command Cord Bundlers, White. Earliest date: Jun. 17, 2001 Website screenshot , Oct. 2, 2015, <http://www.walmart.com/ip/3M-17304-Command-Cord-Clips-17304-White/13174062>.

Trudeau Silicone Multi-Use Tie Wraps. Earliest date: May 13, 2010. Website screenshot , Oct. 2, 2015, <http://www.shoptrudeau.com/Reusable-Tie-Wraps-Set-of-8-p/0999030.htm>.

Fusionbrands 15-Inch Silicone Food Loop. Earliest date: Jun. 29, 2011. Website screenshot , Oct. 2, 2015, <http://www.bhg.com/shop/fusion-brands-fusionbrands-15-inch-silicone-food-loop-trussing-tool-pink-set-of-4-p7f882344f31930188f4b466a11aa38a7.html>.

Q Knot Reusable Cable Tie. Earliest date: Apr. 27, 2010. Website screenshot , Oct. 2, 2015, <http://www.containerstore.com/s/office/cord-control/q-knot-multi-purpose-reusable-ties/12d?productId=10028260>.

Planet Waves Elastic Cable Ties. Earliest date: Dec. 11, 2012. Website screenshot , Oct. 2, 2015, <http://www.planetwaves.com/pwProductDetail.Page?ActiveID=4115&productid=598>.

Nite Ize Gear Tie Reusable Rubber Twist Tie. Earliest date: Apr. 2, 2011. Website screenshot , Oct. 2, 2015, <http://www.lapolicegear.com/niteize-gtmp-11-a1-geartie-assort.html>.

* cited by examiner

ELASTIC TIE AND METHODS OF USING AND MANUFACTURING THE SAME

CROSS-REFERENCE TO RELATED APPLICATION

This non-provisional patent application claims the benefit of U.S. Provisional Patent application Ser. No. 62/044,365, filed on Sep. 1, 2014, the disclosure of which is incorporated herein by reference in its entirety.

BACKGROUND

1. Technical Field

The present disclosure relates in general to tying loose items together and, in particular, to elastic and malleable ties and the methods for using and manufacturing the same.

2. Description of Related Art

With the increasing prevalence of tools and gadgets, there is a need to bundle and tie various items to keep them organized, secure, and conveniently accessible. Without the proper bundling or tying, these items may get entangled, such as in the case of power cords, cables, chains, and ropes. They may also get loose and lost, such as in the case of pencils, pens, brushes, pipes and tubes.

There are many available products for use in tying. They can be classified as a number of different types, such as, for example, straps (a belt or with VELCO); cable ties; twist ties; stretchable bands with hooks and loops; pliable ties with hooks and loops; tubes; and cable sleeves. Ideally, the products should be usable to securely and efficiently tie items while also being easy to use. There is a need for an improved tying device.

BRIEF SUMMARY

Tying devices for easily and securely tying items and methods for using and manufacturing the same are provided. In some embodiments, a tying device can comprise an elastic band, having malleable elements at both ends.

In some embodiments, the tying device includes an elongated elastic band. The band can be made from material that is not only elastic but also has a gripping surface on the exterior that provides for friction contact against objects and/or against itself, when the band is overlapped our wound in overlapping fashion. In some embodiments, the band is tubular, or otherwise has an internal chamber or cavity, and malleable wires or malleable elements are inserted into the cavity at each end of the elastic band, with the malleable elements extending into the band but not extending along the full length of the band. Also, the malleable elements can each be provided with a pull knob fixedly attached thereto, such that when the malleable wires are coupled to the band at either end, the pull knobs are positioned at the outer end portions of the malleable wires. In some embodiments, the pull knobs are embedded within the band, by pressing the knobs into the cavity of the band along with the malleable wire, so that malleable wire and band are both within the cavity of the band at either end thereof.

In some embodiments, methods for manufacturing a tying device are provided. The methods include providing a tubular elastic band, providing a knob fixedly attached to an outward end of malleable wire, inserting an inside end of the malleable wire into an internal chamber of the band, and passing the inside end of the wire inwardly into the chamber until the knob on the outward end abuts against a rim on the end of the band, then pressing the knob into the internal chamber of the elastic band a sufficient distance until the band surrounds the lateral edges of the knob and the knob is securely held within the band, at end portions of the band.

In still other embodiments, methods for using tying devices are provided. The methods can include the steps of anchoring a first end of the tying device against an object; pulling an elastic band of the tying device to stretch it under tension; winding, or looping the extended elastic band around an item, or group of items, to overlap the tying device, including the elastic band, about itself; and anchoring a second end of the tying device by bending a malleable element coupled to the elastic band.

DETAILED DESCRIPTION

In the following description, certain specific details are set forth in order to provide a thorough understanding of various embodiments of this disclosure. However, upon reviewing this disclosure one skilled in the art will understand that the invention may be practiced without many of these details. In other instances, well-known or widely available structures associated with wires or plastic tubes or plants, have not been described in detail to avoid unnecessarily obscuring the descriptions of the embodiments of the present disclosure.

Various embodiments of the present disclosure are described herein for purposes of illustration, in the context of application to a cord bundle in a particular manner. However, as those skilled in the art will appreciate upon reviewing this disclosure, the tying devices of the present disclosure may be used to tie any of a variety of objects to hold them together, or to retain them, or their portions, in particular positions (e.g., holding a cord in bundled configuration).

In the present description, where used, the terms "about" and "consisting essentially of" mean±20% of the indicated range, value, or structure, unless otherwise indicated. It should be understood that the terms "a" and "an" as used herein refer to "one or more" of the enumerated components. The use of the alternative (e.g., "or") should be understood to mean either one, both, or any combination thereof of the alternatives, unless expressly stated otherwise. As used herein, the terms "include" and "comprise" are used synonymously, and those terms and variants thereof are intended to be construed as non-limiting.

Figure 1:
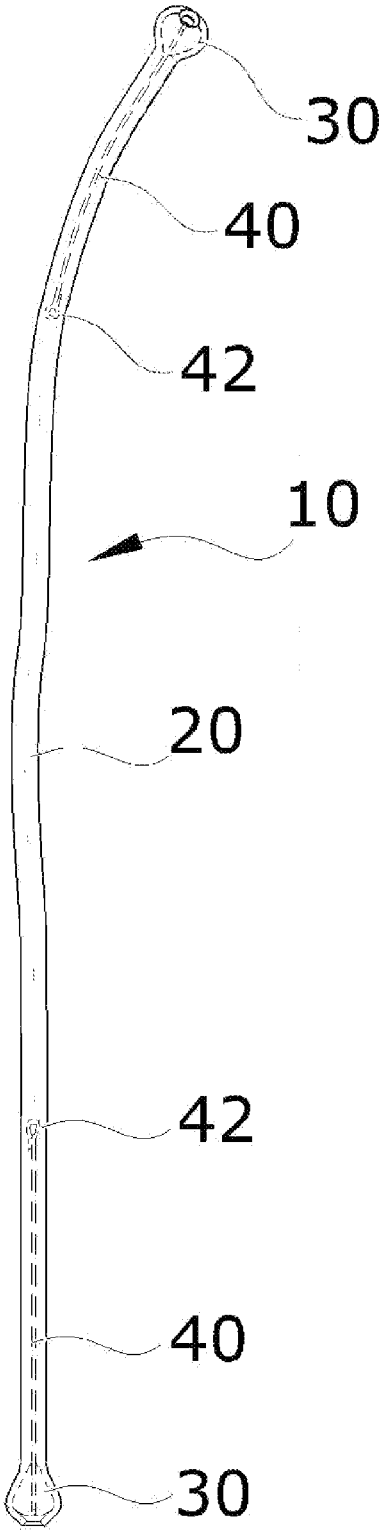
FIG. 1 is a perspective view of a tying device, in accordance with some embodiments of the present disclosure.

In some embodiments, a tying device 10 for tying objects, or portions thereof, together, is provided, as shown in FIGS. 1-3*c*. FIG. 1 is a perspective view of the tying device 10, in accordance with some embodiments of the present disclosure. The tying device 10 comprises of an elastic tube 20, or an elastic band having an internal axial chamber, and at least one knob 30 (which is part of a malleable wire assembly, as described below). In some embodiments, two knobs 30 are provided, one disposed at each end portion of the elastic tube 20, with each knob being part of a malleable wire assembly.

Figure 2:
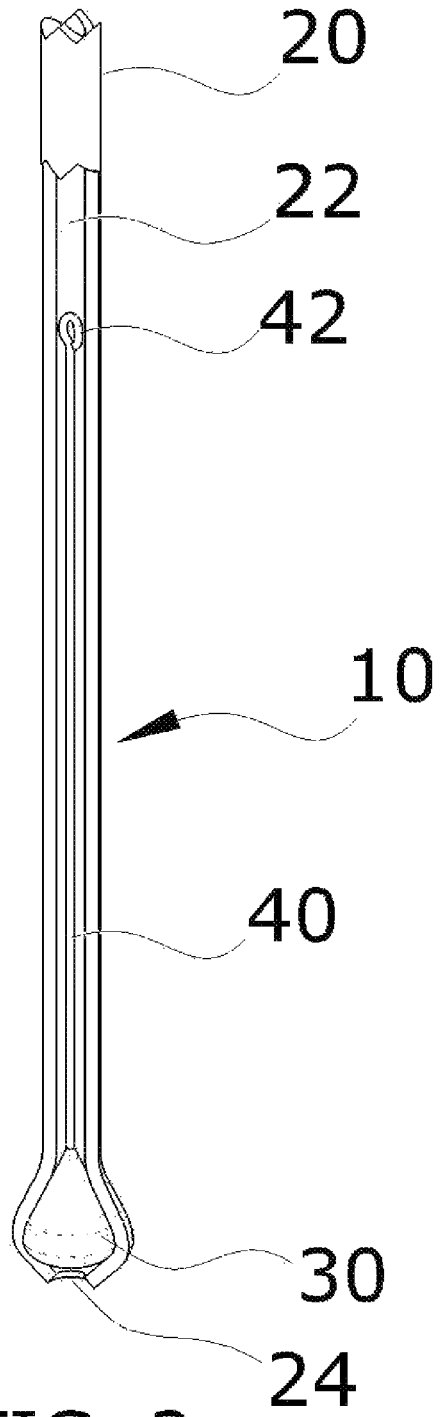
FIG. 2 is partial cross sectional perspective view of the tying device 10.

As best seen in FIG. 2, the malleable wire assembly comprises the pull knob 30, fixedly attached to an elongated malleable wire 40. A first end portion, or inner end portion, of the wire 40 can be formed into a loop 42, with an end of the wire at the first end portion having been bent back toward a second end portion of the wire 40. An enlarged view of the wire 40 and loop 42 are also shown in FIG. 3*b*. Still referring to FIG. 2, in some embodiments, all, or a majority, of the length of the wire 40 is inserted into an axial chamber 22 of the elastic tube 20 through a first end opening 24 of the elastic tube; however, the wire 40 does not extend the entire length of the elastic tube 20.

In some embodiments, a second identical, or similar, malleable wire assembly (also comprising a pull knob 30 fixedly attached to an elongated malleable wire 40, and also having a loop 42 at a first end portion of the malleable wire), is coupled to a second end of the elastic tube in the same or similar manner as described above. For example, FIG. 1 shows both ends of the elastic tube 20, having a wire 40 and knob 30 assembly disposed within the axial chamber of the elastic tube 20. In some embodiments, the pull knob 30 of each of the malleable wire assemblies has a greater lateral diameter than a lateral diameter of the axial chamber 22 of the elastic tube 20, and thus the pull knobs 30 can be press fit into the axial chamber 22 during construction, to couple the malleable wire assemblies within the elastic tube 20.

In some embodiments, the wire 40 can be constructed of mild steel, and can be 20 gauge wire, with a diameter of about 0.032 inches. In some embodiments, a length of the wire 40, measured from a top end of the loop 42 (relative to FIG. 2) to a location at the top of the knob 30 (relative to FIG. 2), is 4 inches. In other embodiments, this measured length of the wire can be greater than, or less than, 4 inches.

In some embodiments, the elastic band 20 is made from rubber latex or polyisoprene rubber, such as, for example, without limitation, Graham-Field Latex Tubing sold by GF Health Products of Atlanta Ga., Item Number 3931 14. In further embodiments, an exterior gripping function of the elastic band 20 may be enhanced by adding texturing to the surfaces of the elastic band to increase its surface area for contact.

In some embodiments, a total length of the elastic band 20 may vary depending on its application. In some embodiments, the band 20 has a resting un-tensioned length of 14 inches, measured end to end, before insertion of the plastic knobs 30, an outside diameter of about 0.25 inches, a wall thickness of about 0.0625 inches and an inside diameter of about 0.125 inches.

Figure 3A:
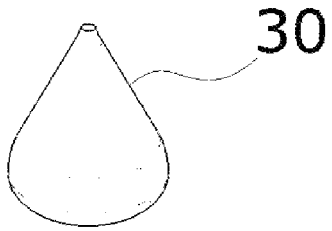
FIG. 3*a* is a perspective view of a pull knob for the tying device of FIG. 2.
Figure 3B:
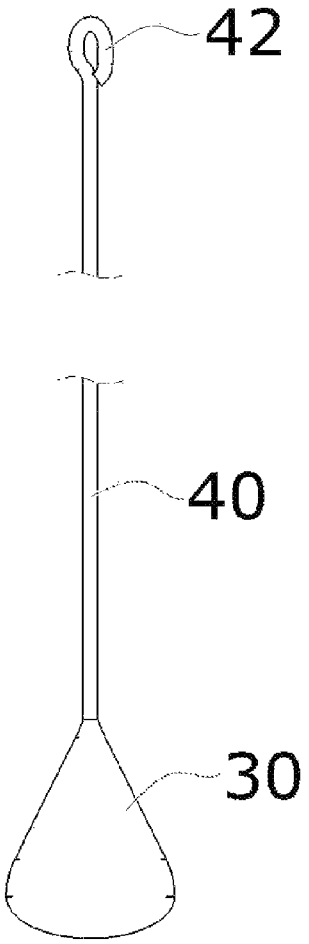
FIG. 3*b* is a partial side elevation view of a wire for the malleable wire assembly, having an end loop.

Referring to FIG. 3*a*, in some embodiments, the pull knob 30 is made of a plastic material that is smooth, moldable and hard but not brittle. In some embodiments, the maximum diameter of the knob 30 can be about 0.40 inches, and a length of the knob 30, as measured along a longitudinal axis of the elastic tube 20, can be about 0.49 inches. In other embodiments, the knob 30 can have a greater diameter, or smaller diameter, and a greater length or lesser length. An inward portion of the pull knob 30 (top portion relative to FIG. 3*a*) can taper, or have a conical, or tear drop shape. This tapered shape can facilitate insertion of the knob 30 into the chamber 22 of the elastic tube 20. In still another embodiment, the pull knob 30 has a circular cross section throughout with a curved pointed taper on top and a more rounded taper on the bottom. The tapered form can serve as a strain relief for the wire 40 when it is over-molded with the knob 30, such as shown in FIG. 2. In other embodiments, the pull knob 30 can have different shapes, as will be appreciated by those skilled in the art after reviewing this disclosure. In still yet other embodiments, the pull knob may have a hook, loop or other similar part attached to and protruding from an outer end portion, so that the hook or loop, etc., can be used to attach the tying device 10 to other objects, such as for hanging the tying device from another hook.

Figure 3C:
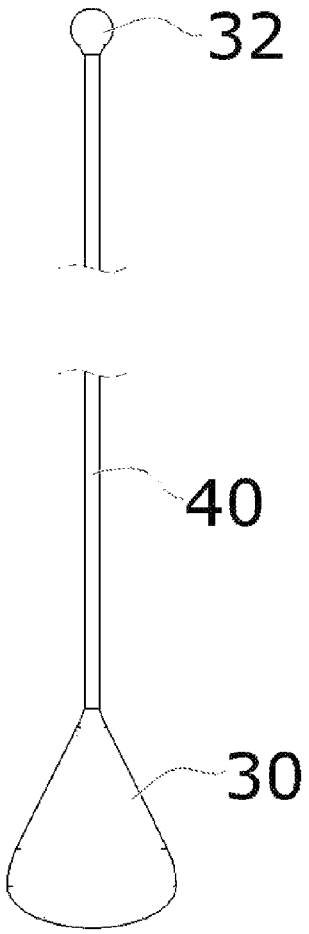
FIG. 3*c* is a partial side elevation view of a wire for the malleable wire assembly, having a rounded element in lieu of the end loop.
Figure 4:
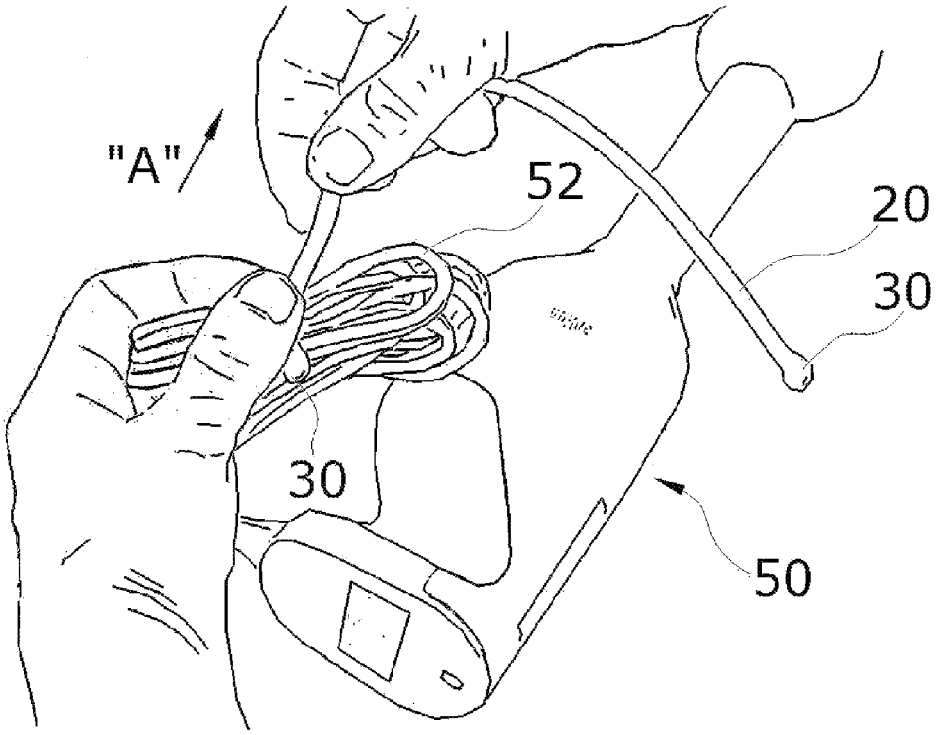
FIG. 4 is a perspective view of a user engaging a tying process using the tying device of FIG. 1 on a bundled cord (of an appliance 50), initiating the tying process by anchoring a first end portion of the tying device on the bundled cord and holding the first end portion against the bundled cord with the user's thumb.
Figure 5:
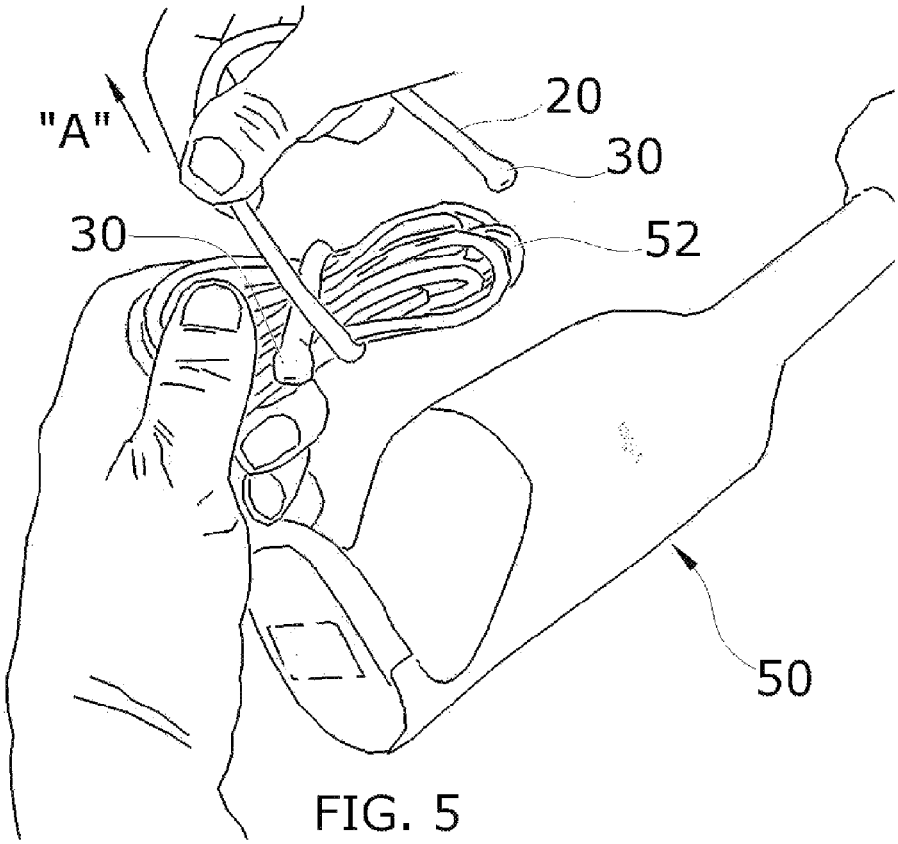
FIG. 5 is a perspective view of the bundled cord and tying device of FIG. 4, but illustrating a subsequent step of the tying process wherein the user has pulled a free portion of the tying device to stretch it while wrapping the tying device about the cord bundle in a manner that overlaps the previously anchored first end portion of the tying device.
Figure 6:
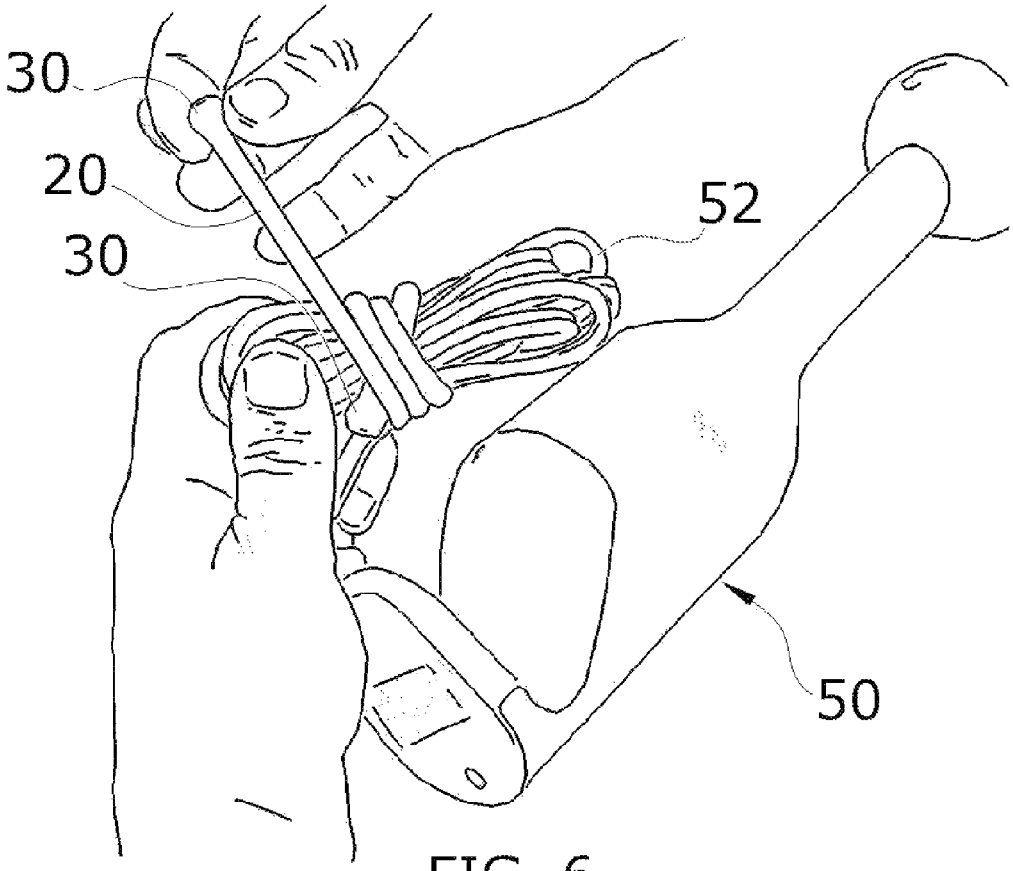
FIG. 6 is a perspective view of the bundled cord and tying device of FIG. 5, illustrating a subsequent step of the tying process wherein the user has wrapped the elastic band portion of the tying device about the bundled cord multiple times, with at least a portion of the elastic band overlapping and contacting itself under tension, until only a second end portion of the tying device containing the malleable wire assembly remains free, without slack.

While a second end (or outer end) of the malleable wire 40 is attached to the pull knob 30, a first end (or inner end) of the malleable wire 40 is terminated with a loop 42 (as described earlier) or an otherwise a smooth, or rounded element 32, as best seen in FIGS. 3*b* and 3*c*. A lateral diameter of the loop 42, or other rounded element 32, can be typically smaller than an interior diameter of chamber 22, so as not to interfere with the elastic tubing 20 during use of the tying device 10, and to facilitate easy insertion of the malleable wire 40 into the tubing 20.

In some embodiments, the wire 40 may be substituted with a substance that can fill a portion of the internal chamber 22 of the elastic tube 20. For example, the substance can be a gel, liquid, solid that would cause an end portion of the tying device 10 to be substantially permanently malleable, to hold shape once bent, rather than being elastic, such that the end portion can provide substantially similar function to that occupied by the wire 40. Also, in some embodiments, a coating can be provided, on interior and/or exterior walls of end portions of the elastic tubing to impart wire-like malleable characteristics to those end portions, to confer a suitable degree of malleability and rigidness emulating that of the malleable wire.

Furthermore, in some embodiments, the malleable wire 40 can be inserted, attached or otherwise coupled to, end portions of the elastic band 20 by any variety of bonding, molding or forming processes without attachment to a pull knob. In the process of attachment the elastic band can be formed into a pull knob like structure at the end of the band.

Furthermore, in some embodiments, the elastic band is not tubular, and can instead, be an elongated strip of elastic material, or otherwise can lack an internal chamber or cavity. Malleable elements can be attached, or otherwise, coupled to, end portions of such an elastic band by any of a variety of bonding or molding processes, again, to impart malleability and rigidity to the end portions of the elastic band, sufficient to mimic the functions imparted by the malleable wire (as further described herein).

Methods for Using the Tying Devices

Methods for using the tying device 10 to tightly and snugly wrap, tie, bundle, fasten, or bind an object, or portions thereof, are provided. The steps can include: 1) anchoring a first end portion of the tying device 10 to an object; 2) wrapping the elastic band 20 of the tying device 10 in stretched fashion around the object to contact at least two, or more, surface portions of the elastic band 20 in overlapping fashion, while stretching and placing the elastic band 20 under tension, and 3) anchoring the tying device by bending the malleable wire assembly of the second end portion of the tying device, comprising the wire 40, about at least a portion of the object, contacting the object and/or a wrapped portion of the elastic band 20. The elastic band 20 in tension generates a tight and snug tying of the otherwise loose object, while the overlapping portions thereof provide frictional grip, which can be enhanced by the stretched surface of the elastic band, and that frictional grip combined with the anchoring of the malleable wire after it is bent about the object, provide sufficient holding strength to tightly retain the tying device in wrapped configuration. Indeed, in some embodiments, the final anchoring step does not require a user to twist the second end portion of the tying device 10, or loose end portion, about the first end portion (e.g., like a twist tie), but instead, as long as the second end portion is bent about a surface curvature over the object being tied, of about more than 180 degrees, and pressed against that contact surface by the user, the combination of friction of the overlapping portions of the elastic band 20 and the curvature of the malleable wire 40 in the second end portion, will be sufficient to retain the tying device 10 snuggly in wrapped configuration about the object. In other embodiments, even if the second end portion is bent about a surface of curvature less than 180 degrees, but between about 90 degrees and about 180 degrees, the tying device 10 will be retained in snugly wrapped configuration.

Figure 7:
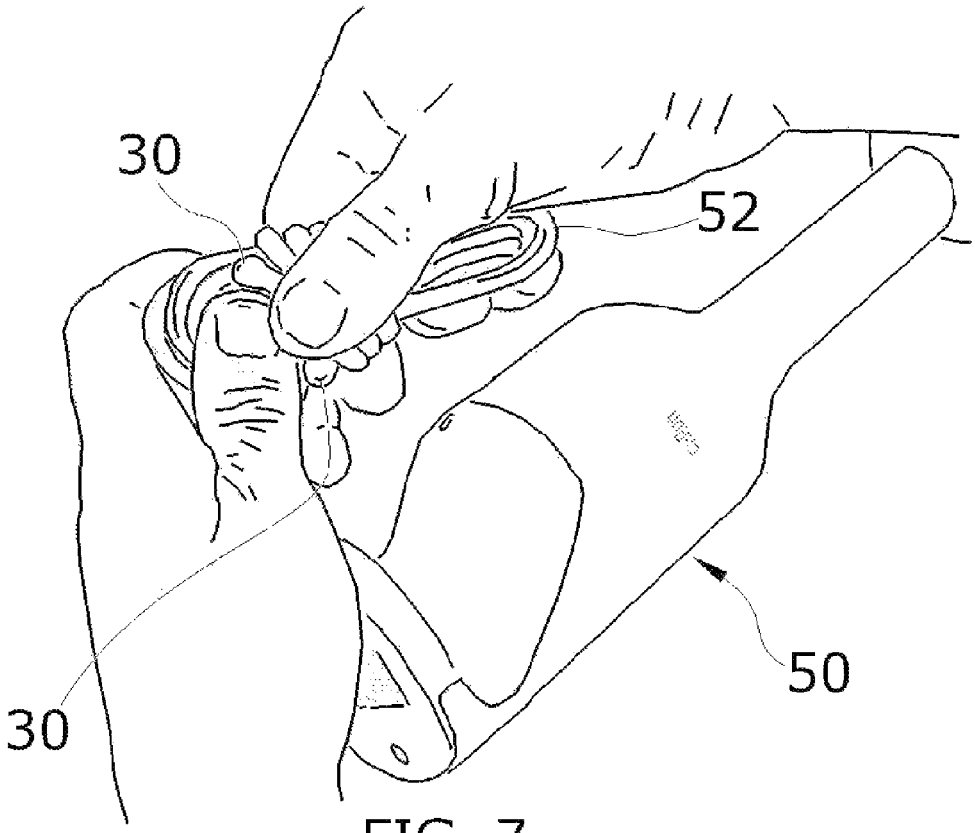
FIG. 7 is a perspective view of the bundled cord and tying device of FIG. 6, illustrating a subsequent step of the tying process wherein the user has bent the malleable wire assembly (contained within a second end portion of the elastic band), against a surface of the bundled cord, and/or against a surface of the stretched elastic band wrapped about the bundled cord, to secure the tying device about the bundled cord.
Figure 8A:
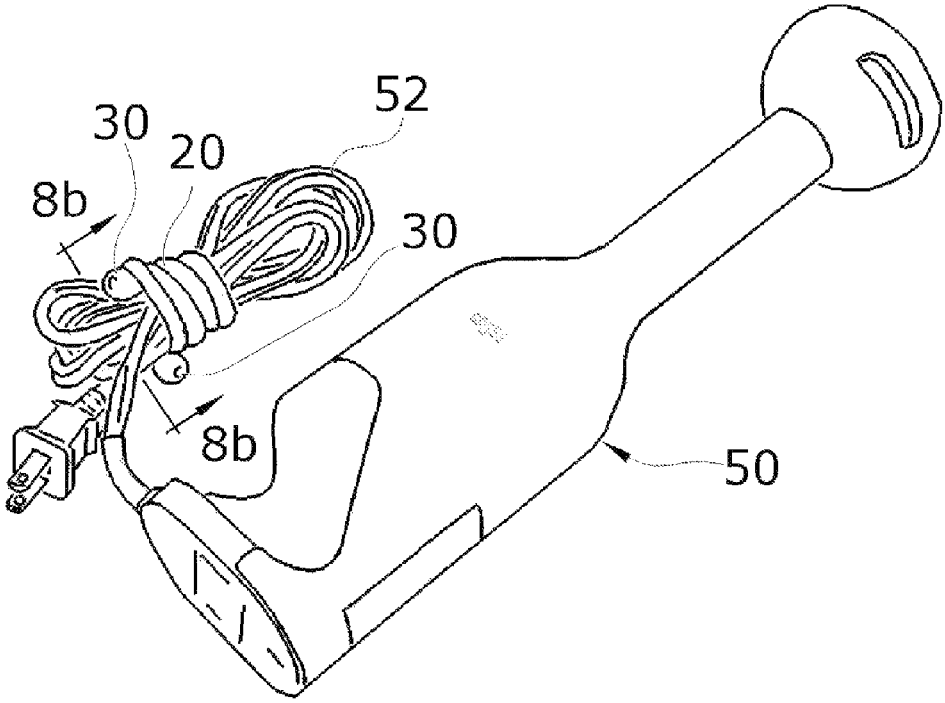
FIG. 8*a* is a perspective view of the bundled cord and tying device of FIG. 7, illustrating the completed tying process as reflected in FIGS. 4-7 and described herein, with the tying device securely attached to the bundled cord under tension, and securely retaining the bundled cord in a bundled fashion.
Figure 8B:
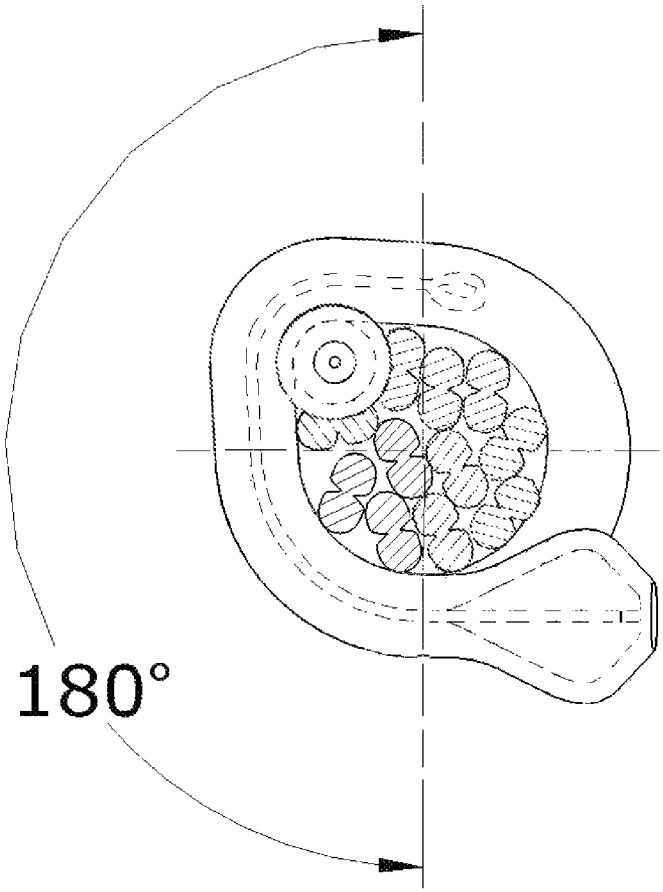
FIG. 8*b* is a side elevation view of the tying device as viewed from line 8*b*-8*b* in FIG. 8*a*, showing the curvature of the tying device about the bundled cord.

For example, as shown in FIGS. 4-8*b*, a user that wishes to tie a cord 52 in a bundle to retain it for storage, can 1) hold, or anchor, a first end portion of the tying device 10, having a pull knob 30, against the cord 52 bundle (See, e.g., FIG. 4) pull a free portion of the tying device 10 to stretch the elastic band 20, such as in the direction of arrow "A;" 2) wrap the tying device 10 about the cord 52 while pulling the tying device 10 to maintain the elastic band under tension until the elastic band 20 overlaps the initially anchored first end portion (See, e.g., FIG. 5); 3) continue to wrap the tying device 10 about the bundled cord 52 surface while pulling the tying device 10 to keep it stretched under tension until all but a second end portion comprising the malleable wire assembly therein is free (See, e.g., FIG. 6); and 4) bend the malleable wire 40 in the second end portion of the tying device 10 about the surface of the bundled cord 52, and/or about a surface of the elastic band 20 surrounding that surface, such that a total maximum curvature of the malleable wire 40 about the surface is more than 180 degrees, to allow the tying device 10 to be self-retained in stretched configuration about the bundled cord 52 (See, e.g., FIGS. 7, 8*a* and 8*b*).

Untying the tying device 10 from the position shown in FIG. 8*a* is easy. A user simply displaces, or unbends, the second end portion of the tying device until its overall curvature is less than 180 degrees, or less than 90 degrees, whereupon the elasticity of the elastic band will cause the tying device 10 to self-contract, and thereby, free itself from the cord 52 bundle.

Example steps for using the tying device have been illustrated and described with reference to one of the structural embodiments described above; however, as well be appreciated by those skilled in the art after reviewing this disclosure, various ones of the other structural embodiments described can also be used in a similar manner to achieve similar results. Also, in some embodiments, the total bended curvature of the second end portion of the tying device 10 required to retain the snuggly wrapped configuration of the tying device under tension may vary, depending on, among other things, the friction established by the surface of the elastic band 20 when stretched, balanced against a tension of the elastic band 20 when stretched, and balanced against a rigidity of the malleable wire 40 once bent. These factors can be impacted by material selection, although example materials have been described herein.

Manufacturing the Tying Devices

In some embodiments, a method for manufacturing the tying device 10 can include forming the end loop 42 on the wire 40 by bending one end of the wire in a circular arc shape. Alternatively, the rounded element 32, in the form of a sphere or tear drop or similar shape, can be produced and affixed to the one end of the wire 40 after the cutting of the wire. The pull knob 30 can be attached to the other end of the wire, in the manner described below.

In some embodiments, the pull knob 30 may be produced using plastic injection molding as an over mold to the wire 40. Alternatively, the pull knob 30 may be produced separately and subsequently affixed to the wire 40 after the wire has been cut to length. The wire 40 can be inserted into a molded cavity in the separately generated knob 30, and injected plastic can be formed around the wire. In one embodiment, a rounded element 32 may be provided as an alternative to the loop 42 on the wire in a similar manner. In still another embodiment, a malleable wire 40 of the appropriate length is placed on a mold cavity and both the pull knob 30 and the rounded element 32 can be formed from injecting plastics axially around the wire.

Once the malleable wire assembly is formed (comprising the cut malleable wire, fixedly attached pull knob at a second end thereof, and having an end loop or being fixedly attached to a rounded element at the first end thereof), it can be fully or partially inserted into an elastic tube 20, by initially inserting the first end into the axial chamber 22 of the tube 20. The rounded element 32 or loop 42 help avoid damage to the elastic tubing by an otherwise sharp edge wire 40.

Working Example

Referring to FIG. 8*b* and Table 1 below, an experiment was conducted to determine an appropriate bend angle (also referred to above as "curvature") of the malleable wire 40 of the tying device 10 as it is applied to the wrapping of a test wooden cylinder. This experiment takes into consideration the dual function of the frictional grip provided by the elastic band 20 combined with the anchoring of the end of the tying device 10 using the malleable wire 40 after it is bent into a curvature about the object. The bend angle is the minimum angle measured before slippage would occur where the tying device and tied objects would become untied.

For the experiment, the elastic band 20 measured an outside diameter of about 0.25 inches, a wall thickness of about 0.0625 inches, an inside diameter of about 0.125 inches and was 14 inches in length. The effective length is the length in the middle of the elastic band 20 measured between the 0.50 inch pull knobs 30 which will not be in tension before tying an object and equates to 13 inches. The malleable wire 40 was a 20 gauge wire of approximately 0.032 inches in diameter, 4 inches in free length protruding from the pull knob 30. A wrap cylinder (simulating an everyday object) was a 1 inch diameter wooden dowel circular cross section rod that approximates the diameter of a bundled cord prior to tying.

The wrap cylinder was wrapped for 6 revolutions, as a bundled cord might be. The stretched effective length of the tying device 10 around the wrap cylinder was calculated to be 21.3 inches which when it was stretched in a linear fashion was measured in tension to resist a force of 3 pounds. After wrapping, the malleable wire 40 attached to the pull knob 30 was bent around the wrap cylinder in a curved manner, similar to that shown in FIG. 8*b*. After wrapping the malleable wire was curved/formed around the cylinder of approximately 270° for a tight snug hold, without any spontaneous release (e.g., approximating normal use), and then the wire 40 was slowly straightened tangentially to the cylinder until the tying device began to slip. The resulting slip bend angle was determined to be 180°, showing that the tying device of this working example can be curved as little as 180° around the object as described, and still be snuggly retained, and requires no more than approximately 270° bend angle to be snugly retained for everyday use. This working example is not intended to be limiting, and provided as an example to illustrate the effectiveness of the tying device 10 given certain material/component specifications. Various aspects of the material/component specifications could be changed/modified within the spirit and scope of the present disclosure, as will be immediately apparent to those skilled in the after reviewing this disclosure.

TABLE 1

| Determination of Malleable Wire Hook Angle in Degrees | |
|---|---|
| Elastic band - tube length at rest | 14 |
| Effective length (minus the Length of pull knobs) | 13 |
| Malleable wire - 20 Gauge (0.032 inches diameter) | |
| Malleable wire - length in inches | 4 |
| Wrap cylinder diameter in inches | 1 |
| number of wraps | 6 |
| Stretched Length (in inches) | 21.3 |
| Stretched length tension in pounds force | 3.0 |
| Bend angle of wire around wrap cylinder (before slipage) | 180 |

After reviewing the present disclosure, an individual of ordinary skill in the art will immediately appreciate that some details and features can be added, removed and/or changed without deviating from the spirit of the invention. Reference throughout this specification to "one embodiment," "an embodiment," or "some embodiments," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A tying device, comprising:

an elongated elastic member having a first end portion and a second end portion;

a first elongated malleable member disposed proximate the first end portion, the first elongated malleable member being configured to be manually malleable;

a second elongated malleable member disposed proximate the second end portion, the second elongated malleable member being configured to be manually malleable; and wherein each of the first elongated malleable member and second elongated malleable member extend less than a full length of the elongated elastic member whereby the first elongated malleable member and the second elongated malleable member are linearly spaced apart along a length of the elongated elastic member.

2. The tying device of claim 1 wherein the first elongated malleable member is at least partially contained within the elongated elastic member.

3. The tying device of claim 1 further comprising a knob attached to the first elongated malleable member, the knob being wider in diameter than the elongated elastic member.

4. The tying device of claim 1 wherein the elongated elastic member is tubular.

5. The tying device of claim 4 wherein the first elongated malleable member comprises a malleable wire at least partially disposed within an internal chamber of the elongated elastic member.

6. The tying device of claim 5 further comprising a knob fixedly attached to the malleable wire and at least partially disposed within the internal chamber of the elongated elastic member, with a maximum diameter of the knob being greater than a maximum resting diameter of the internal chamber.

7. The tying device of claim 5 further comprising a rounded element or loop disposed at an inner end of the malleable wire.

8. The tying device of claim 1 wherein the elongated elastic member is comprised of rubber.

9. The tying device of claim 8 wherein the first elongated malleable member is comprised of a steel wire.

10. The tying device of claim 9 wherein the steel wire is 20 gauge wire.

11. The tying device of claim 1 wherein the elongated elastic member is tubular and further comprising a first knob member attached to an end portion of the first elongated malleable member and a second knob member attached to an end portion of the second elongated malleable member, the first knob member and second knob member each being attached to the elongated elastic member to couple the first elongated malleable member and second elongated malleable member to the elongated elastic member, and wherein at least a portion of each of the first elongated malleable member and second elongated malleable member is disposed within a cavity of the elongated elastic member without being fixedly directly attached to any surface of the elongated elastic member, whereby the elongated elastic member can move relative to the at least a portion of each of the first elongated malleable member and second elongated malleable member.

12. A tying device comprising:

an elongated elastic member having an internal cavity;

a first elongated manually malleable member at least partially inserted in the internal cavity proximate a first end of the elongated elastic member, the first elongated manually malleable member extending less than a full length of the elongated elastic member;

a second elongated manually malleable member at least partially inserted in the internal cavity proximate a second end of the elongated elastic member, the second elongated manually malleable member extending less than a full length of the elongated elastic member, whereby the first elongated manually malleable member and the second elongated manually malleable member are linearly spaced apart along a length of the elongated elastic member; and at least a first knob fixedly attached to the first elongated manually malleable member and at least partially contained within the internal cavity.

13. The tying device of claim 12 wherein the knob has a tapered end portion.

14. The tying device of claim 12 wherein an inner end of each of the first and second elongated manually malleable members has a looped or rounded configuration.

15. The tying device of claim 12 wherein the elongated elastic member is a rubber tube.

16. The tying device of claim 12 wherein each of the elongated manually malleable members comprises a mild steel wire.

17. The tying device of claim 12 wherein a material of construction of the elongated elastic member comprises rubber latex or polyisoprene rubber.

* * * * *